US010844827B2

(12) United States Patent
Sugiura et al.

(10) Patent No.: US 10,844,827 B2
(45) Date of Patent: Nov. 24, 2020

(54) IGNITION DEVICE FOR INTERNAL COMBUSTION ENGINE

(71) Applicant: DENSO CORPORATION, Kariya, Aichi-pref. (JP)

(72) Inventors: Akimitsu Sugiura, Kariya (JP); Kaori Doi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/502,437

(22) Filed: Jul. 3, 2019

(65) Prior Publication Data

US 2020/0011284 A1 Jan. 9, 2020

(30) Foreign Application Priority Data

Jul. 4, 2018 (JP) ..... 2018-127422

(51) Int. Cl.

| | |
|---|---|
| ***F02P 9/00*** | (2006.01) |
| ***F02P 3/01*** | (2006.01) |
| ***F02D 41/30*** | (2006.01) |
| ***H01T 13/02*** | (2006.01) |
| ***F02P 15/08*** | (2006.01) |

(52) U.S. Cl.

CPC ..... *F02P 9/002* (2013.01); *F02D 41/3023* (2013.01); *F02P 3/01* (2013.01); *F02P 15/08* (2013.01); *H01T 13/02* (2013.01)

(58) Field of Classification Search

CPC .... F02P 9/002; F02P 3/01; F02P 3/051; F02P 3/053; F02P 15/08; F02D 41/3023; H01T 13/02

USPC ..... 123/627, 636

See application file for complete search history.

(56) References Cited

U.S. PATENT DOCUMENTS

| | | | | |
|---|---|---|---|---|
| 3,488,545 | A * | 1/1970 | Wright | H01T 13/16 313/143 |
| 4,329,615 | A * | 5/1982 | Tanaka | H01T 13/20 313/139 |
| 4,331,899 | A * | 5/1982 | Nishida | H01T 13/32 313/139 |
| 6,202,604 | B1 * | 3/2001 | Silvers | F02D 15/04 123/169 EC |
| 6,213,108 | B1 * | 4/2001 | Boyer | F02P 3/02 123/595 |
| 2006/0201475 | A1 | 9/2006 | Shiraishi | |
| 2013/0291833 | A1 * | 11/2013 | Eisen | F02P 17/12 123/406.12 |
| 2015/0222096 | A1 * | 8/2015 | Nakayama | H01T 13/32 313/142 |
| 2018/0038335 | A1 | 2/2018 | Doi et al. | |

(Continued)

FOREIGN PATENT DOCUMENTS

| | | |
|---|---|---|
| JP | 4239607 | 3/2009 |

*Primary Examiner* — Mahmoud Gimie

(74) *Attorney, Agent, or Firm* — Nixon & Vanderhye PC

(57) ABSTRACT

An ignition device for an internal combustion engine is provided which includes a spark plug and a controller. The spark plug has a housing with a head protruding into a combustion chamber of the engine. The head has at least a portion located downstream of a spark gap of the spark plug in an air-fuel mixture flow within the combustion chamber. The controller works to perform a plurality of discharge events in the spark plug in each cycle of an operation of the engine. This improves the ability of the spark plug to ignite the mixture without need to increase an ignition energy.

6 Claims, 7 Drawing Sheets

(56) References Cited

U.S. PATENT DOCUMENTS

2018/0038338 A1 2/2018 Sugiura et al.
2018/0298869 A1* 10/2018 Forte ..... F02P 15/10

* cited by examiner

IGNITION DEVICE FOR INTERNAL COMBUSTION ENGINE

CROSS REFERENCE TO RELATED DOCUMENT

The present application claims the benefit of priority of Japanese Patent Application No. 2018-127422 filed on Jul. 4, 2018, the disclosure of which is incorporated herein by reference.

BACKGROUND

1 Technical Field

This disclosure relates generally to an ignition device for internal combustion engines.

2 Background Art

Typical ignition devices for internal combustion engines work to create combustion of an air-fuel mixture within a combustion chamber using sparks developed by a spark plug. An initial flame arising from the combustion of the mixture expands to achieve normal combustion of the mixture.

In order to ensure stability in achieving the above normal combustion, multiple ignition systems are known which are designed to produce a plurality of ignition events in each cycle of an operation of the internal combustion engine, that is, per compression stroke in the internal combustion engine.

Usually, when a flow of air-fuel mixture within a combustion chamber is created at a high speed, it will disturb growth of a flame kernel, thus resulting in a difficulty in improving the ignitability of the mixture. Specifically, when a high-speed flow of the mixture is created, a plurality of flames produced by multiple ignitions will be moved by the flow of the mixture away from a spark gap of the spark plug within a short period of time. This disturbs a thermal exchange among the plurality of flames which usually combine and grow together. It is, thus, difficult to enhance the ignitability of the mixture.

An increase in ignition energy in order to enhance the ignitability of the mixture will, however, result in acceleration of mechanical wear of electrodes of the spark plug, which leads to a decrease in service like of the spark plug, or require an ignition coil of the spark plug to have an increased sized. The increase in ignition energy is, therefore, undesirable.

SUMMARY

It is an object of this disclosure to provide an ignition device which is designed to improve the ignitability of mixture in an internal combustion engine without increasing the ignition energy.

According to one aspect of the invention, there is provided an ignition device for an internal combustion engine which comprises: (a) a spark plug equipped with a housing, a center electrode retained inside the housing, and a ground electrode which defines a spark gap between itself and the center electrode; and (b) a controller which controls an operation of the spark plug. The spark plug is mounted in an internal combustion engine with a head of the housing protruding from an inner surface of a combustion chamber into the combustion chamber. The head of the housing protruding into the combustion chamber has at least a portion located downstream of the spark gap in a mixture flow within the combustion chamber. The controller works to perform a plurality of sequential events of discharge in the spark plug in each cycle of an operation of the internal combustion engine.

The spark plug 10 of the ignition device is, as described above, mounted in the internal combustion engine with the head of the housing protruding from the inner surface into the combustion chamber. The protruding head of the housing has at least a portion located downstream of the spark gap in the mixture flow within the combustion chamber. This creates a stagnating region which is located adjacent and downstream of the protruding portion and where the mixture flow has a lower flow velocity. In the stagnating region, the mixture flow is circulated in a swirling or eddy form. The mixture which has flowed near the spark gap and passed the protruding head is sucked into the stagnating region.

The controller is configured to activate the spark plug to achieve a plurality of ignitions in each operation cycle of the internal combustion engine. This sequentially develops flames near the spark gap in each operation cycle of the internal combustion engine. Each of the flames is moved or drifted by the mixture flow attracted into the stagnating region, so that it stays near the stagnating region within the combustion chamber. This causes the first flame to collide with the second flame which has occurred following the first flame, so that they are combined or mixed. This facilitates growth of a flame within the combustion chamber and enhances the ignition of the mixture.

In the above way, the flames and are mixed to create a grown flame, thereby facilitating the ignition of the mixture without need to increase the ignition energy within the whole of the combustion chamber.

The above structure of the ignition device is capable of improving the ability of the spark plug to ignite the mixture without need for increasing the ignition energy.

In this disclosure, symbols in brackets represent correspondence relation between terms in claims and terms described in embodiments which will be discussed later, but are not limited only to parts referred to in the disclosure.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
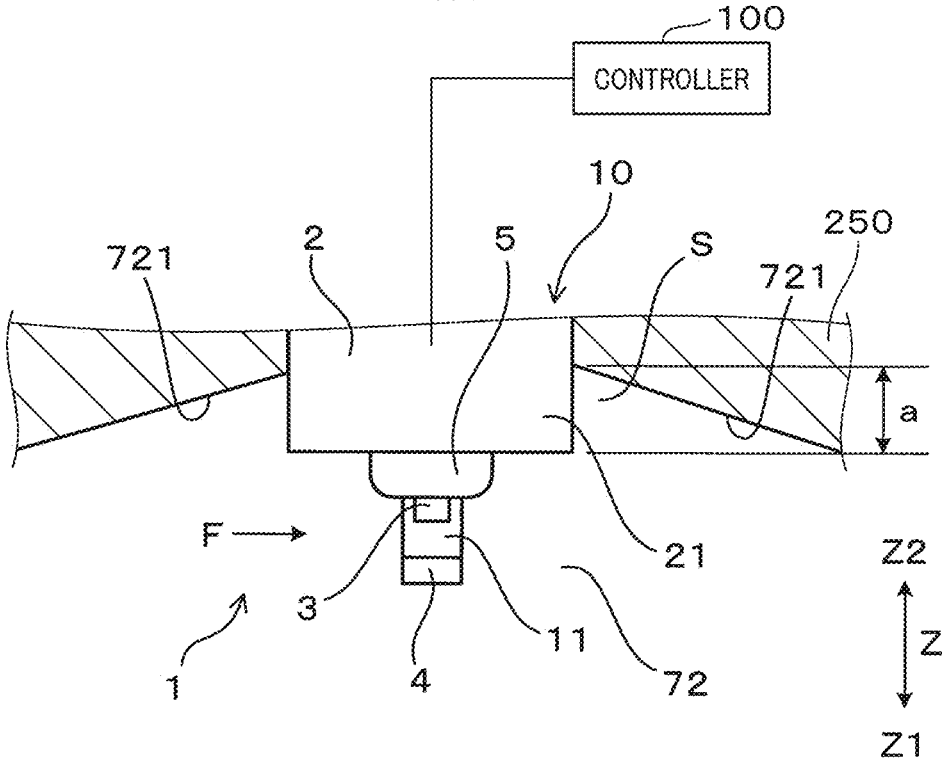
FIG. 1 is a partially longitudinal sectional view which illustrates an ignition device according to the first embodiment.

Prior to describing preferred embodiments, the discussion will refer to prior art multiple ignition systems which are designed to produce a plurality of ignition events in each cycle of an operation of the internal combustion engine, that is, per compression stroke in the internal combustion engine. For instance, Japanese Patent No. 4239607 teaches a controller to control multiple ignitions as a function of a growth rate of a flame kernel.

Usually, when a flow of air-fuel mixture within a combustion chamber is created at a high speed, it will disturb growth of a flame kernel, thus resulting in a difficulty in improving the ignitability of the mixture. Specifically, when a high-speed flow of the mixture is created, a plurality of flames produced by multiple ignitions will be moved by the flow of the mixture away from a spark gap of the spark plug within a short period of time. This disturbs a thermal exchange among the plurality of flames which usually combine and grow together. It is, thus, difficult to enhance the ignitability of the mixture.

An increase in ignition energy in order to enhance the ignitability of the mixture will, however, result in acceleration of mechanical wear of electrodes of the spark plug, which leads to a decrease in service like of the spark plug, or require an ignition coil of the spark plug to have an increased sized. The increase in ignition energy is, therefore, undesirable.

First Embodiment

FIGS. 1 to 5 illustrate the ignition device 1 for internal combustion engines according to an embodiment.

The ignition device 1 includes the spark plug 10 and the controller 100 which works to control an ignition operation of the spark plug 10.

The spark plug 10 includes the housing 2 (also called a metal shell), the center electrode 3 retained inside the housing 2, and the ground electrode 4 which defines the stark gap 11 between itself and the center electrode 3.

In use of the spark plug 10, the housing 2 is, as illustrated in FIG. 1, mounted in the internal combustion engine 250 with a head thereof exposed to the combustion chamber 72. In other words, the head of the housing 2 protrudes from the base-side inner surface 721 of the internal combustion engine 250 into the combustion chamber 72. In the following discussion, a direction away from the spark plug 10 inside the combustion chamber 72 in a lengthwise direction (i.e., an axial direction) of the spark plug 10 will also be referred to as a top side Z1, while an opposite direction away from the combustion chamber 72 in the axial direction of the spark plug 72 will also be referred to as a base side Z2.

The housing 2 has the protruding head 21 extending from the base-side inner surface 721 to the top side Z1. The protruding head 21 is arranged at least to have a portion located downstream of the spark gap 11 in a flow of an air-fuel mixture (which will also be referred to as a mixture flow F) within the combustion chamber 72.

Figure 2:
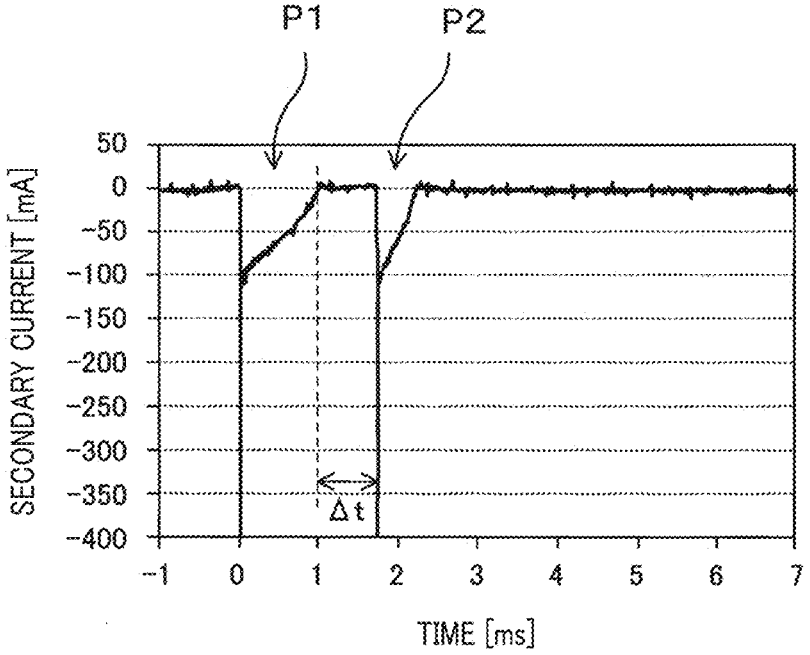
FIG. 2 is a graph which demonstrates a waveform of a secondary current supplied to a spark plug in the first embodiment.

The controller 100, as demonstrated in FIG. 2, works to control an operation of the spark plug 10 to achieve a plurality of ignitions in each cycle of an operation of the internal combustion engine 250, that is, per compression stroke of a piston in the internal combustion engine 250.

The spark plug 10 has the center electrode 3 disposed inside the hollow cylindrical housing 2 through the cylindrical porcelain insulator 5. The center electrode 3 has a head protruding from the housing 2 and the porcelain insulator 5 to the top side Z1.

Figure 3:
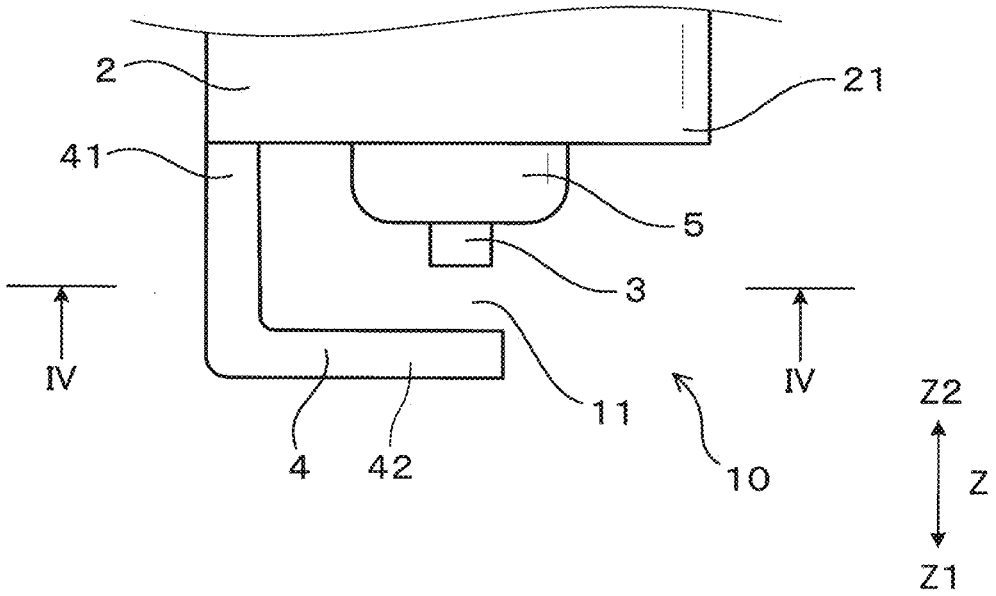
FIG. 3 is a partial side view which illustrates a head of a spark plug in the first embodiment.

The ground electrode 4, as clearly illustrated in FIG. 3, has the upright portion 41 extending from the head of the housing 2 to the top side Z1. The spark gap 11 and the upright portion 41 are, as viewed in the axial direction of the spark plug 10 in FIG. 4, aligned with each other in a direction X. The direction X is different from, in other words, oriented non-parallel to a direction of the mixture flow F within the combustion chamber 72. In the illustrated example, the direction X in which the spark gap 11 and the upright portion 41 are aligned with each other in a direction perpendicular the length of the spark plug 10 is substantially perpendicular to the direction of the mixture flow F within the combustion chamber 72.

Figure 4:
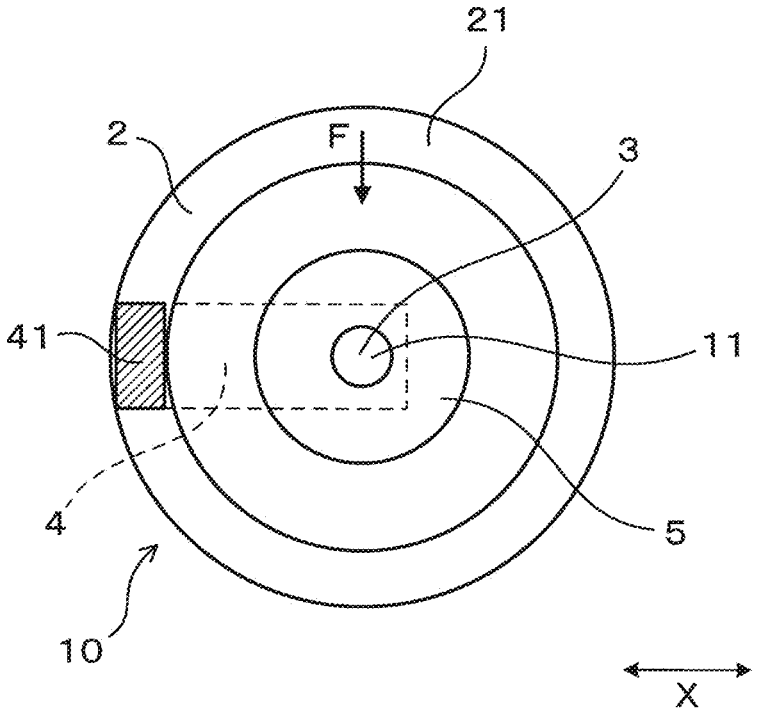
FIG. 4 is a partially sectional view taken along the line IV-IV in FIG. 3.

The ground electrode 4, as clearly illustrated in FIG. 4, has the horizontal portion 42 which is bent or extends from a top end of the upright portion 41 toward the center axis of the spark plug 10. The horizontal portion 42 has an end portion facing the end of the center electrode 3 in the axial direction Z and defines the spark gap 11 between itself and the end of the center electrode 3.

The protruding head 21 extends continuously along the whole of a circumference of the spark plug 10. In other words, the protruding head 21 occupies the entire circumference of the housing 2 and is exposed from the base-side inner surface 721 to the combustion chamber 72 (i.e., toward the top side Z1). In this embodiment, a portion of the spark plug 10 which is inserted into the combustion chamber 72 in the axial direction of the spark plug 10 is also referred to as the top side Z1, while the opposite side is also be referred to as the base side Z2.

The base-side inner surface 721 of the combustion chamber 72 is, as clearly illustrated in FIG. 1, inclined obliquely from near the circumference of the spark plug 10 outwardly toward the inside of the combustion chamber 72. The protruding head 21 of the spark plug 10 protrudes from the base-side inner surface 721 located adjacent the outer circumference of the spark plug 10 toward the top side Z1. In other words, the protruding head 21 is exposed from the base-side inner surface 721 of the engine 250 which defines the combustion chamber 72 to the inside of the combustion chamber 72. The protruding head 21 preferably protrudes from the base-side inner surface 721 toward the top side Z1 by 1.5 mm or more. In other words, a distance a between a circumferential portion of the housing 2 (i.e., the protruding portion 21) which is located adjacent or closest to an inside edge of the base-side inner surface 721 and an end surface of the protruding head 21 exposed to the combustion chamber 72 is preferably 1.5 mm or more in the axial direction of the spark plug 10.

The ignition device 1 in this embodiment may be used as an igniter for internal combustion engines mounted in vehicles, such as, automobiles.

The ignition device 1 is designed to have mounted therein an ignition coil, not shown, and apply a high-voltage, as developed at the ignition coil, to the spark plug 10 to create electric sparks in the spark gap 11. Such a spark-creating time, in other words, a time at which the high-voltage is applied to the spark plug 10 is controlled by the controller 100.

The ignition coil is equipped with a primary coil and a secondary coil which are magnetically connected together. The controller 100 works to control a primary current flowing in the primary coil, thereby controlling a secondary current flowing in the secondary coil. Specifically, cutting off the primary current flowing to the primary coil will result in induction of a secondary voltage in the secondary coil, which is, in turn, applied as the high-voltage to the spark plug 10, thereby causing sparks to be created in the spark gap 11, so that the secondary current flows in the spark gap 11.

The controller 100, as described above, works to perform a plurality of ignitions in the spark plug 10 in each cycle of the operation of the internal combustion engine 250. Specifically, the controller 100, as demonstrated in FIG. 2, produces secondary currents P1 and P2 which are delivered from the ignition coil to the spark plug 10 at sequential times. In FIG. 2, a waveform denoted by "P1" represents a secondary current created by a first event of electrical discharge in the spark plug 10. "P2" represents a secondary current created by a second event of electrical discharge in the spark plug 10.

In other words, an ignition energy (i.e., electrical energy) is delivered from the ignition coil to the spark plug 10 at a plurality of sequential times in each cycle of the operation of the internal combustion engine 250. A discharge interval $\Delta t$ that is a time interval between adjacent events of the ignitions in the spark plug 10 is selected to be 2 msec. or less. In this embodiment, the two ignitions are performed in each cycle of the operation of the internal combustion engine 250.

The amounts of the ignition energy consumed by the two ignitions are selected to be substantially identical with each other.

The embodiment offers the following beneficial advantages.

Figure 5:
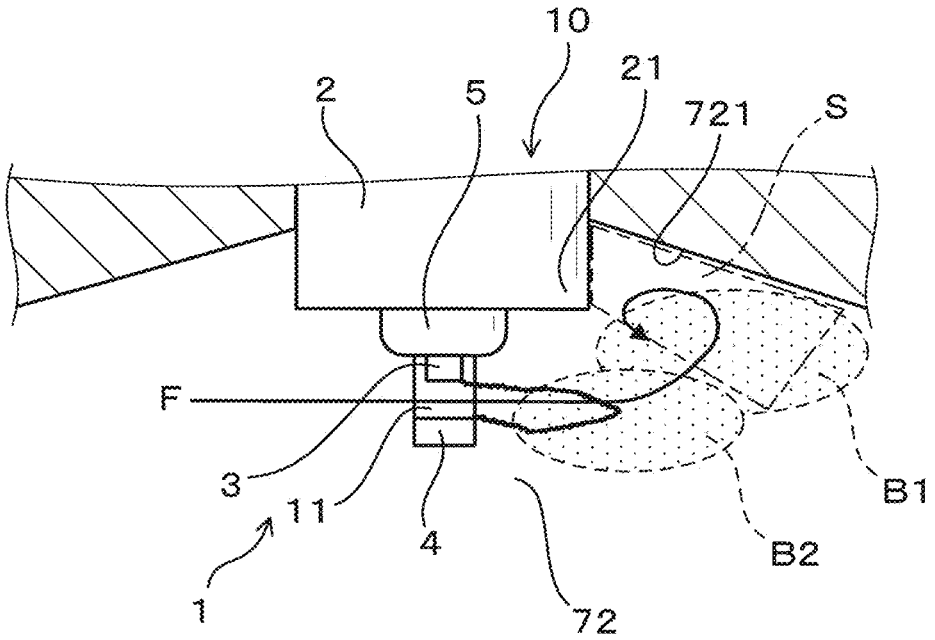
FIG. 5 is a partially sectional view for describing beneficial effects offered in the first embodiment.

The spark plug 10 of the ignition device 1 is, as described above, mounted in the internal combustion engine 250 with the head of the housing 2 protruding from the base-side inner surface 721 to the top side Z1 within the combustion chamber 72. The protruding head 21 of the housing 2 has at least a portion located downstream of the spark gap 11 in the mixture flow F within the combustion chamber 72. This, as illustrated in FIG. 5, creates the stagnating region S which is located adjacent and downstream of the protruding portion 21 and where the mixture flow F is ceased. In the stagnating region S, the mixture flow F is circulated in a swirling or eddy form. The mixture which has flowed near the spark gap 11 and passed the protruding head 21 is sucked into the stagnating region S.

The controller 100 is, as already described with reference to FIG. 2, configured to activate the spark plug 10 to achieve a plurality of ignitions in each operation cycle of the internal combustion engine 250. This, as demonstrated in FIG. 5, sequentially develops flames B1 and B2 near the spark gap 11 in each operation cycle of the internal combustion engine 250. Each of the flames B1 and B2 is moved or drifted by the mixture flow F attracted into the stagnating region S, so that it stays near the stagnating region S within the combustion chamber 72. This causes the first flame B1 to collide with the flame B2 which has occurred following the flame B1, so that they are combined or mixed. This facilitates growth of a flame within the combustion chamber 72 and enhances the ignition of the mixture.

In the above way, the flames B1 and B2 are mixed to create a larger flame, thereby facilitating the ignition of the mixture without need to increase the ignition energy within the whole of the combustion chamber 72.

The spark gap 11 and the upright portion 41 are, as viewed in the axial direction of the spark plug 10 in FIG. 4, aligned with each other in the direction X. The direction X is oriented non-parallel to the direction of the mixture flow F within the combustion chamber 72. This facilitates elongation of a spark by the mixture flow F, thereby enhancing the ability of the spark plug 10 to ignite the mixture. In this embodiment, the direction X is substantially perpendicular to the direction of the mixture flow F, thereby more enhancing the ability of the spark plug 10 to ignite the mixture.

The protruding head 21 extends continuously along the whole of a circumference of the spark plug 10. This facilitates arrangement of at least a portion of the protruding head 12 downstream of the spark gap 11 in the direction of the mixture flow F regardless of orientation of the spark plug 10 mounted in the internal combustion engine 250 and also enables the housing 2 to be formed in a simple shape, thereby resulting in a decrease in production cost of the spark plug 10.

The structure of the spark plug 10 in this embodiment is, as described above, capable of enhancing the ability of the spark plug 10 to ignite the mixture without increasing the ignition energy.

Second Embodiment

Figure 6:
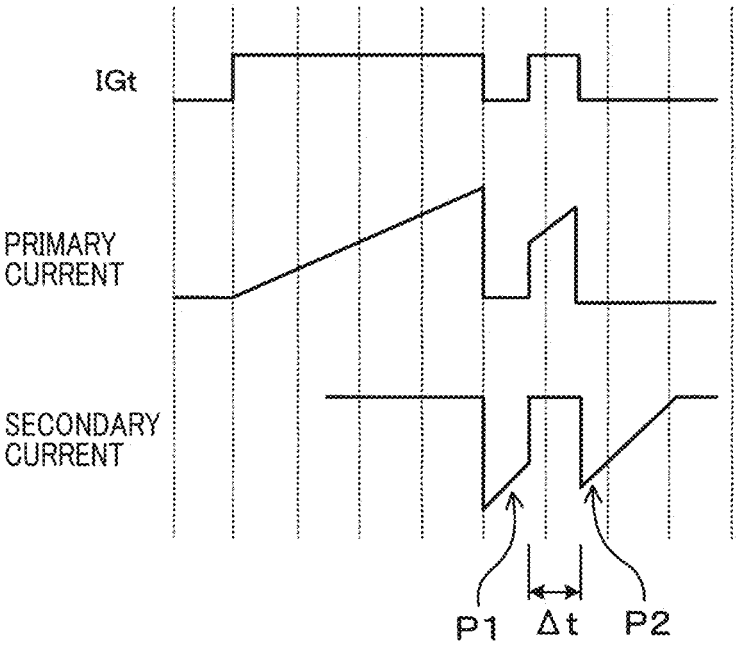
FIG. 6 is a graph which demonstrates waveforms of an ignition signal, a primary current, and a secondary current in the second embodiment.

FIG. 6 illustrates a modification of how to control the discharge in the spark plug 10.

Specifically, the controller 100 works to terminate the first occurring secondary current P1 that is an earlier one of two successive secondary currents halfway before the first occurring secondary current P1 is fully completed.

FIG. 6 illustrates changes in the ignition signal IGt and the primary and secondary currents in the ignition coil with time. The secondary currents P1 and P2 are delivered to the spark plug 10 to create a first and a second electrical discharge or spark. Each of the secondary currents P1 and P2 has a peak immediately after a corresponding one of the first and second sparks is produced and then gradually decreases.

The second secondary current P2 is, like in the first embodiment illustrated in FIG. 2, gradually decreased at a given rate to zero, while the first secondary current P1 is, unlike in the first embodiment, first gradually decreased at a given rate and then intentionally suddenly interrupted before it reaches zero at the given rate.

Specifically, the controller 10, as illustrated in FIG. 6, first turns on, that is, changes the ignition signal IGt to a high level to deliver the primary current to the ignition coil, so that electrical energy is stored in the ignition coil. Subsequently, the controller 100 turns off the ignition signal IGt at a given time to block the delivery of the primary current, so that the secondary current is supplied to the spark plug 10. The electrical energy, as stored in the ignition coil, is delivered to the spark plug 10. The ignition signal IGt is turned on again before the stored electrical energy is fully supplied to the spark plug 10.

The above turning on of the ignition signal IGt will cause the primary oil to flow in the ignition coil again, thereby interrupting the secondary current to the spark plug 10. The electrical energy is, therefore, stored in the ignition coil again. Specifically, the electrical energy is added to that remaining in the ignition coil without being fully consumed by the first discharge. This enables the electrical energy, as required to produce the secondary current P2 (i.e., the second spark), to be stored in the ignition coil within a decrease period of time.

Afterwards, the controller 100 turns off the ignition signal IGt to interrupt the primary current, so that the secondary current P2 is delivered to the spark plug 10 again. This creates the second spark in the spark plug 10.

Other arrangements are identical with those in the first embodiment, and explanation thereof in detail will be omitted here. In the second and following embodiments, the same or similar reference numbers, as employed already, will refer to the same or similar parts.

The controller 100 in the second embodiment is, as apparent from the above discussion, designed to decrease a time interval (i.e., the discharge interval Δt) between the end of the first discharge (i.e., the end of the first secondary current P1) and the start of the second discharge (i.e., the start of the second secondary current P2). In other words, the controller 100 intentionally interrupts or stops the first discharge before it is fully completed to save the electrical energy in the ignition coil. This results in a decrease time it takes to charge, in the ignition coil after the end of the first discharge (i.e., occurrence of the first spark in the spark gap 11), an amount of electrical energy which is required to develop the second discharge (i.e., the second spark in the spark gap 11).

The second discharge (i.e., the second spark) is, therefore, started after the passage of a short amount of time (i.e., the discharge interval Δt) following the termination of the first discharge. This causes the plurality of flames B1 and B2 arising from sequential events of sparks to be produced close to each other, thereby facilitating the mixing of the flames B1 and B2. This more improves the ability of the spark plug 10 to ignite the mixture.

The second embodiment also offers substantially the same other beneficial advantages as in the first embodiment.

Third Embodiment

Figure 7:
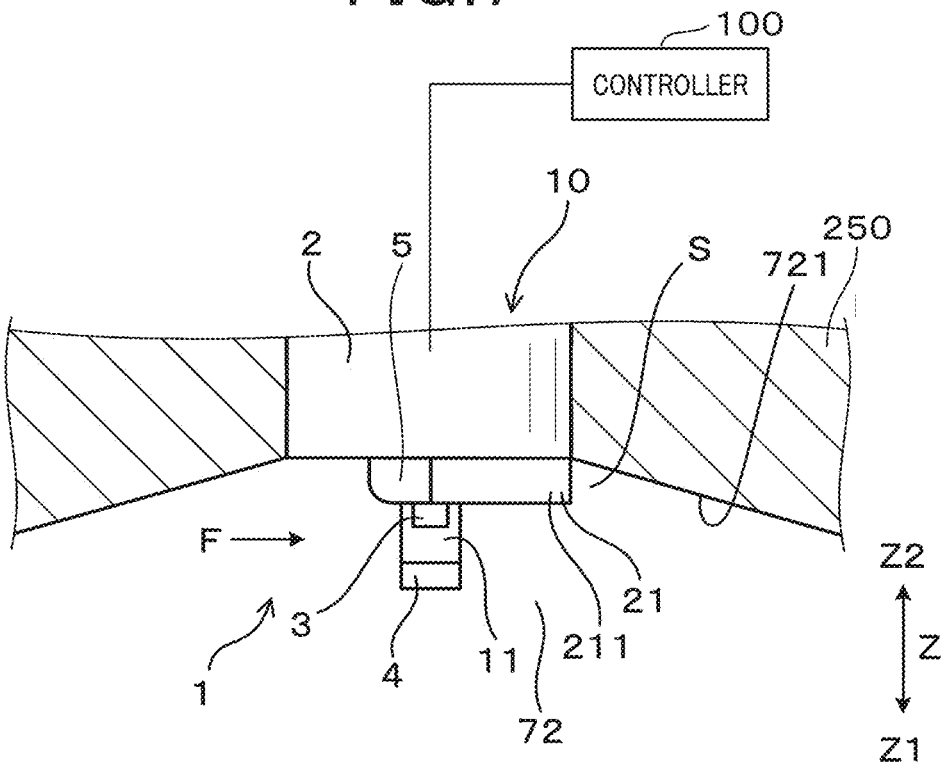
FIG. 7 is a partially longitudinal sectional view which illustrates an ignition device according to the third embodiment.
Figure 8:
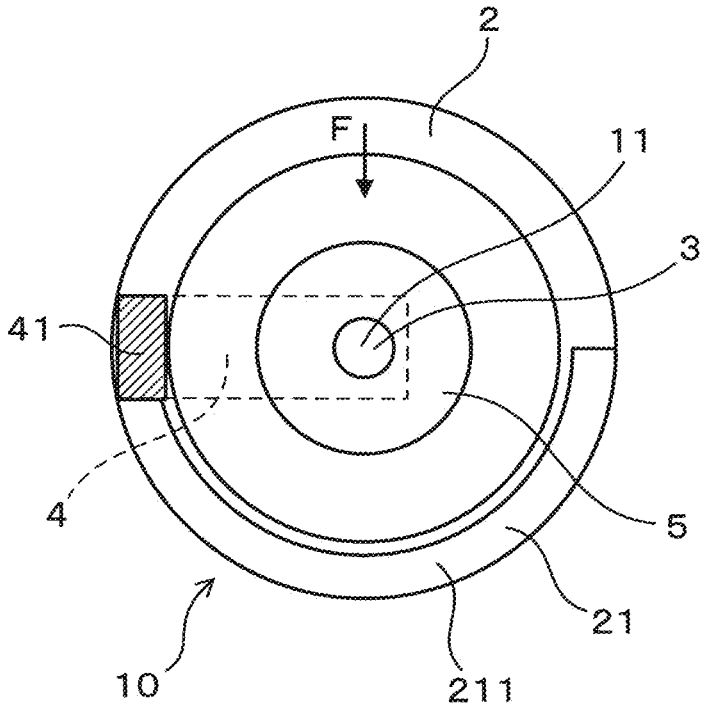
FIG. 8 is a transverse sectional view which illustrates an ignition device according to the third embodiment.

FIGS. 7 and 8 illustrate the spark plug 10 according to the third embodiment which has the housing 2 equipped with the shield wall 211.

Specifically, the shield wall 211 extends from an end of a major body of the housing 2 into the combustion chamber 72. The shield wall 211 is located more downstream than the spark gap 11 is in the direction of the mixture flow F within the combustion chamber 72. The shield wall 211 constitutes the protruding head 21. The shield wall 211 protrudes from the base-side inner surface 721 toward the top side Z1 within the combustion chamber 72.

The shield wall 211 is curved in the circumferential direction of the housing 2 and occupies a portion of an entire circumference of the end of the major body of the housing 2. In other words, the shield wall 211 extends from the portion of the entire circumference of the housing 2 inwardly into the combustion chamber 72, that is, a base end of the spark plug 10 which is located outside the combustion chamber 72. The shield wall 211, as illustrated in FIG. 8, preferably occupies substantially half the circumference of the end of the housing 2. In the illustrated case, the shield wall 211 circumferentially extends from a downstream end of the upright portion 41 of the ground electrode 4 in the direction of the mixture flow F to a place diametrically opposed to the longitudinal center of the upright portion 41 through the center axis of the spark plug 10 (i.e., the center of the center electrode 3).

In use, the spark plug 10 is mounted in the internal combustion engine 250 with the shield wall 211, as viewed in the axial direction Z, located downstream of the spark gap 11 in the mixture flow F within the combustion chamber 72.

The shield wall 21, as clearly illustrated in FIG. 7, has a top end which faces or is exposed to the combustion chamber 72 and is located closer to the base side Z2 (i.e., the base end of the spark plug 10) than the spark gap 11 is.

Other arrangements are identical with those in the first embodiment.

The use of the shield wall 21 enables a degree to which the head of the spark plug 10 protrudes into or is exposed to the combustion chamber 72 to be decreased, especially, on an upstream side of the spark gap 11 in the mixture flow F. This facilitates the ease with which the mixture flow F reaches the spark gap 11, which elongates a spark. The shield wall 211 occupies only a portion of the circumference of the housing 2, thereby resulting in a decrease in overall size of the housing 2. This results in a decrease in loss of an initial flame caused by being cooled by the housing 2 including the shield wall 211, thereby minimizing a risk of a misfire in the combustion chamber 72.

The third embodiment also offers substantially the same other beneficial advantages as in the first embodiment.

EXPERIMENTATION

We conducted experimental tests on the ignition device 1 in the first embodiment. FIGS. 10 to 15 show results of the tests to confirm the beneficial effects of the ignition device 1.

Figure 9:
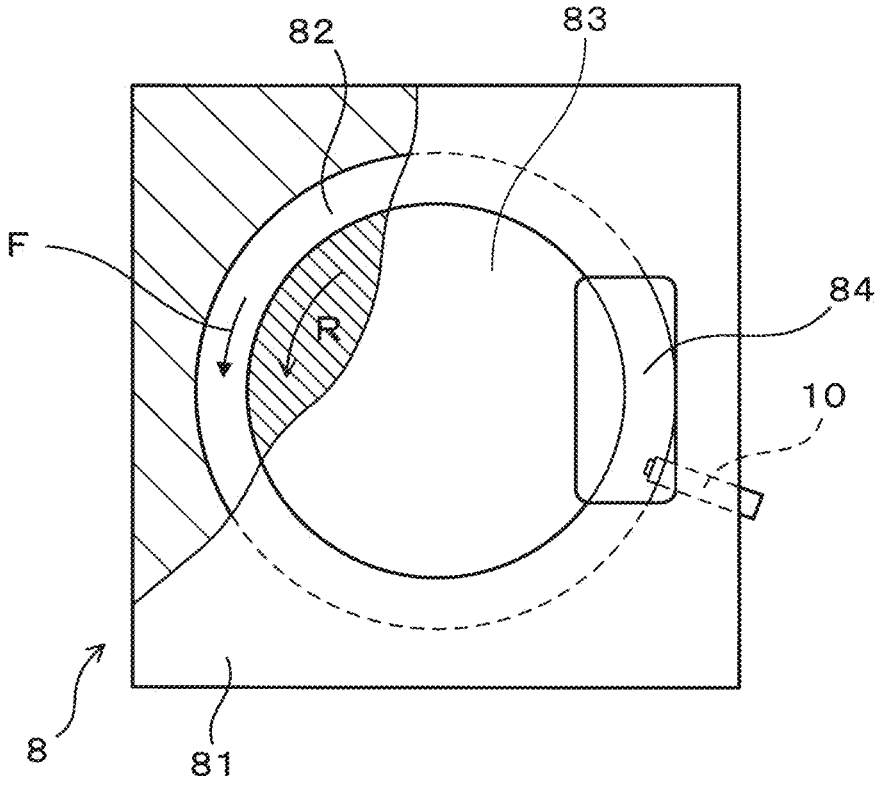
FIG. 9 is a partially sectional plan view which illustrates a fluid bench for experimental tests.

Specifically, we mounted the spark plug 10, as demonstrated in FIG. 9, on the fluid bench 8 and analyzed combustion of an air-fuel fuel within the simulating combustion chamber 82. The fluid bench 8 defines the circular simulating combustion chamber 82 within the bench housing 81. The rotor 83 is disposed inside the simulating combustion chamber 82. The rotor 83 rotates in the direction R to create the mixture flow F within the simulating combustion chamber 82. The bench housing 81 has formed therein the monitor window 84 through which a portion of the simulating combustion chamber 82 is visually monitored from outside the bench housing 81.

In the tests, an air-fuel mixture whose air-fuel ratio is 26 was injected into the simulating combustion chamber 82 to create the mixture flow F moving at a velocity of 5 m/s. The spark plug 10 was mounted in the fluid bench 8 at the same orientation as that in the first embodiment relative to the mixture flow F. The protruding head 21 of the housing 2 was exposed to the simulating combustion chamber 82 by about 5 mm. In other words, the protruding head 21 protruded by the distance a of about 5 mm (see FIG. 1) from the inner wall of the simulating combustion chamber 82. We activated the spark plug 10 in various discharge patterns, as discussed below.

In the discharge pattern No. 1, the spark plug 10 was activated to perform a single event of discharge in each cycle.

In the discharge patterns No. 2 to No. 8, the spark plug 10 was activated to perform two sequential discharge events in each cycle. The discharge intervals Δt in the discharge patterns No. 1 to No. 8 are listed in table 1 below.

TABLE 1

| | Number of discharges | Discharge interval | Index com. velocity |
|---|---|---|---|
| Pattern No. 1 | 1 | — | 4-4 |
| Pattern No. 2 | 2 | 0.7 | 5-5 |
| Pattern No. 3 | 2 | 1.2 | 5-5 |
| Pattern No. 4 | 2 | 1.7 | 4 |
| Pattern No. 5 | 2 | 2.6 | 4-5 |
| Pattern No. 6 | 2 | 3.1 | 3 |
| Pattern No. 7 | 2 | 4.1 | 4 |
| Pattern No. 8 | 2 | 5.1 | 4 |
| Pattern No. 9 | 2 | 6.2 | 4 |

In each discharge pattern, an amount of electrical energy delivered to the spark plug 10 in each cycle was about 80 mJ.

We observed states of combustion of the mixture in the discharge patterns No. 1 to No. 9. Specifically, we took images of the states of combustion through the monitor window 84 of the fluid bench 8 with a high-speed camera using schlieren techniques. The images derived using the schlieren techniques (which will also be referred to below as schlieren images) do not always match outlines of flames, but a portion of the schlieren image where combustion reaction is more active usually appears darker or deeper. Dark portions of the schlieren images match combusted portions of the mixture or flames. In the following discussion, the dark portions of the schlieren images will also be referred to as flames for convenience sake.

The schelieren images were took three times: 10 msec. 15 msec. and 40 msec. after start of the discharge in the spark plug 10. In the discharge patterns No. 2 to 9 where the two sequential events of discharge were performed, the above times are based on the start of the first event of the discharge.

The schlieren images in the discharge patterns in some of the discharge patterns No. 1 to No. 9 are illustrated in FIGS. 10 to 14. In each of FIGS. 10 to 14, the left image represents the schlieren image captured 10 msec. after the start of the discharge. The middle image represents the schlieren image captured 15 msec. after the start of the discharge. The right image represents the schlieren image captured 40 msec. after the start of the discharge.

Figure 10:
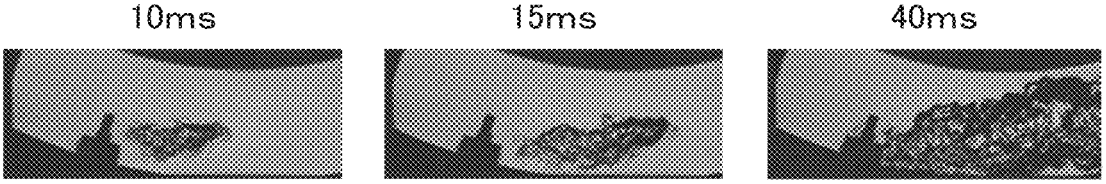
FIG. 10 illustrates schlieren images derived in a discharge patter No. 1 in tests.
Figure 11:
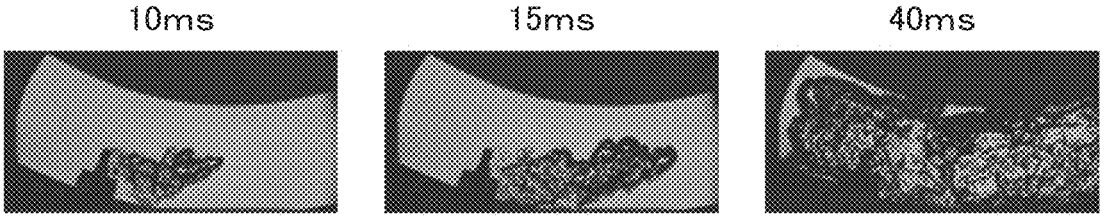
FIG. 11 illustrates schlieren images derived in a discharge patter No. 2 in tests.
Figure 12:
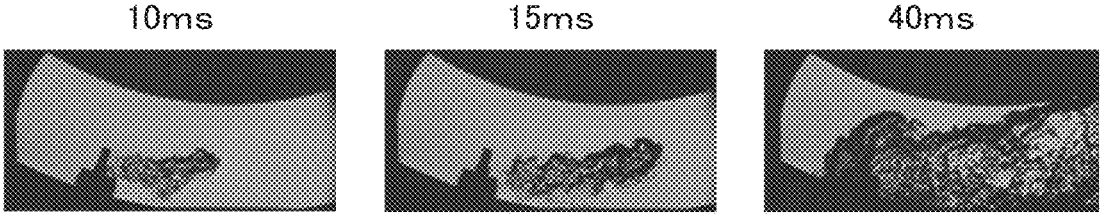
FIG. 12 illustrates schlieren images derived in a discharge patter No. 3 in tests.
Figure 13:
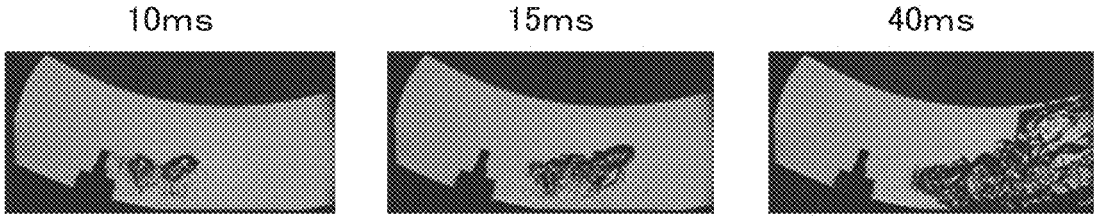
FIG. 13 illustrates schlieren images derived in a discharge patter No. 6 in tests.
Figure 14:
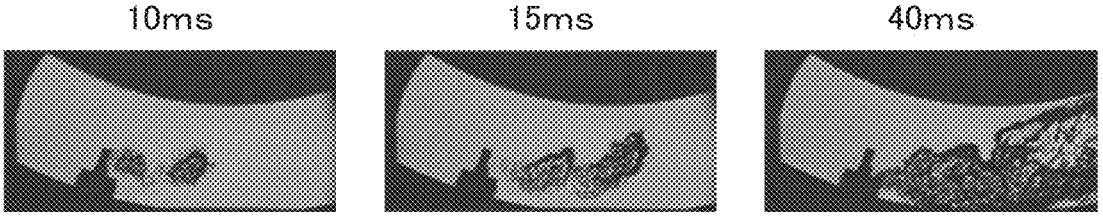
FIG. 14 illustrates schlieren images derived in a discharge patter No. 8 in tests.

FIG. 10 shows the schlieren images in the discharge pattern No. 1. FIG. 11 shows the schlieren images in the discharge pattern No. 2. FIG. 12 shows the schlieren images in the discharge pattern No. 3. FIG. 13 shows the schlieren images in the discharge pattern No. 6. FIG. 14 shows the schlieren images in the discharge pattern No. 8. The schlieren images in the other discharge patterns are omitted.

The schlieren images show that the flame is first moved by the mixture flow F downstream (i.e., the right side in the images) away from the spark plug 10 and then expands to create a flow of the flame back to the spark plug 10. Particularly, in the discharge patterns No. 2 and No. 3, the flame expands greatly. This shows that two sequential events of the discharge performed at the decreased discharge interval Δt facilitate the expansion of a flame.

We also more objectively evaluated the schlieren images in the discharge patterns according to index combustion velocities. We classified locations of leading portions of the flames moving back to the spark plug 10 in 40 msec. after the start of the discharge into five types. Specifically, the leading portions of the flames moving back to the spark plug 10 which lie between the center of the monitor window 84 and the spark plug 10 are labeled as the level 3. The leading portions of the flames lies over the spark plug 10 are labeled as the level 4. The leading portions of the flames lies upstream (i.e., the left side in the drawings) of the spark plug 10 are labeled as the level 5. There are no schlieren images to which the levels 1 and 2 are applicable. The levels 1 and 2 will, therefore, not be referred to in this disclosure.

Figure 15:
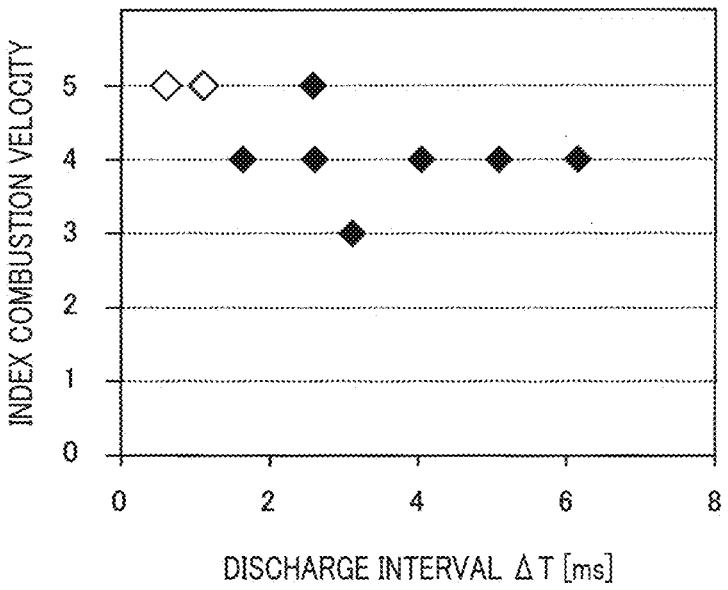
FIG. 15 is a graph which represent results of evaluation in tests and shows a relation between a discharge interval and a combustion velocity.

Results of the evaluation using the index combustion velocities are represented by the above table 1 and FIG. 15. "4-4", "5-5", or "4-5" in the item "index combustion velocity" in table 1 indicate facts that results of two repeated tests each express the level 4 or the level 5 or express the level 4 and the level 5, respectively. In each of the discharge patterns No. 4 and No. 6 to No. 9, only one test was performed. In FIG. 15, white plots represent facts that the same index combustion velocities were derived in two tests.

Table 1 and the graph in FIG. 15 show that the combustion velocities are high in the discharge patterns No. 2 and No. 3 and that the ignition device 1 in the first embodiment designed to perform two sequential events of the discharge in the spark plug 10 enhances the combustion velocity and improves the ability of the spark plug 1 to ignite the mixture. It is also found that a decrease in the discharge interval Δt will result in an increase in combustion velocity. It is preferable that the discharge interval Δt is selected to be 1.5 msec. or less.

The regulation of the discharge interval Δt may be achieved in the following way. The controller 100 may change the discharge interval Δt as a function of a speed of or a load on the internal combustion engine 250. Usually, when the speed of the internal combustion engine 250 is increased, it will result in an increase in velocity of the mixture in the combustion chamber. The discharge interval Δt is, therefore, preferably shortened with an increase in speed of the engine 250. When the load on the engine 250 is decreased, it will result in a decrease in temperature in the combustion chamber. The discharge interval Δt is, therefore, preferably shortened with a decrease in load on the engine 250. The controller 100 may regulate the discharge interval Δt in the above way using a sensor measuring the velocity of the mixture in the combustion chamber or temperature in the combustion chamber.

The controller 100 may alternatively shorten the discharge interval Δt with a decrease in amount of electrical energy for the discharge in the spark plug 10.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. An ignition device for an internal combustion engine comprising:

a spark plug equipped with a housing, a center electrode retained inside the housing, and a ground electrode which defines a spark gap between itself and the center electrode; and a controller which controls an operation of the spark plug, wherein the spark plug is mounted in an internal combustion engine with a head of the housing protruding from an inner surface of a combustion chamber into the combustion chamber, wherein the head of the housing protruding into the combustion chamber has at least a portion located downstream of the spark gap in a mixture flow within the combustion chamber, and wherein the controller works to perform a plurality of sequential discharge events in the spark plug in each cycle of an operation of the internal combustion engine; and the portion of the head of the housing protruding into the combustion chamber defines a stagnating region which is located adjacent and downstream of the head and where the mixture flow is ceased.

2. An ignition device for an internal combustion engine as set forth in claim 1, wherein the controller works to intentionally interrupt a first discharge event that is an earlier one of the two sequential discharge events before completion of the first discharge event.

3. An ignition device for an internal combustion engine as set forth in claim 1, wherein the ground electrode has an upright portion extending away from a top end of a major body of the housing, and wherein the upright portion and the spark gap are, as viewed in an axial direction of the spark plug, aligned with each other in a direction which is non-parallel to a direction of the mixture flow within the combustion chamber.

4. An ignition device for an internal combustion engine as set forth in claim 1, wherein the head of the housing occupies an entire circumference of the housing in a circumferential direction of the spark plug.

5. An ignition device for an internal combustion engine as set forth in claim 1, wherein the head of the housing includes a shield wall which extends from an end of a major body of the housing and is located downstream of the spark gap in the mixture flow within the combustion chamber.

6. An ignition device for an internal combustion engine as set forth in claim 1, wherein the stagnating region is configured to circulate the mixture flow in a swirling or eddy form.

* * * * *